United States Patent [19]

Mortensen

[11] 4,019,393

[45] Apr. 26, 1977

[54] ENGINE STARTER GEARING

[75] Inventor: Harold Richard Mortensen, Horseheads, N.Y.

[73] Assignee: Facet Enterprises, Inc., Tulsa, Okla.

[22] Filed: Jan. 12, 1976

[21] Appl. No.: 648,441

[52] U.S. Cl. ..... 74/6

[51] Int. Cl.[2] ..... F02N 15/06

[58] Field of Search ..... 74/6, 7 R, 7 A

[56] References Cited

UNITED STATES PATENTS

| | | | |
|---|---|---|---|
| 3,263,509 | 8/1966 | Digby | 74/6 |
| 3,714,834 | 2/1973 | Digby | 74/6 |

*Primary Examiner*—Allan D. Herrmann

*Attorney, Agent, or Firm*—Remy J. VanOphem

[57] ABSTRACT

The present invention relates to starter gearing of the positive shift dentil type overrunning clutch wherein provisions are made for the resilient means to absorb the torsional loads on the housing body after the starter gearing has become engaged with the engine ring gear, thereby enabling the elimination of a bearing sleeve member under the pinion gear and enabling the use of smaller sized pinion gears, resulting in the use of said starter gearing on smaller pinion gear applications.

18 Claims, 2 Drawing Figures

FIG. 1
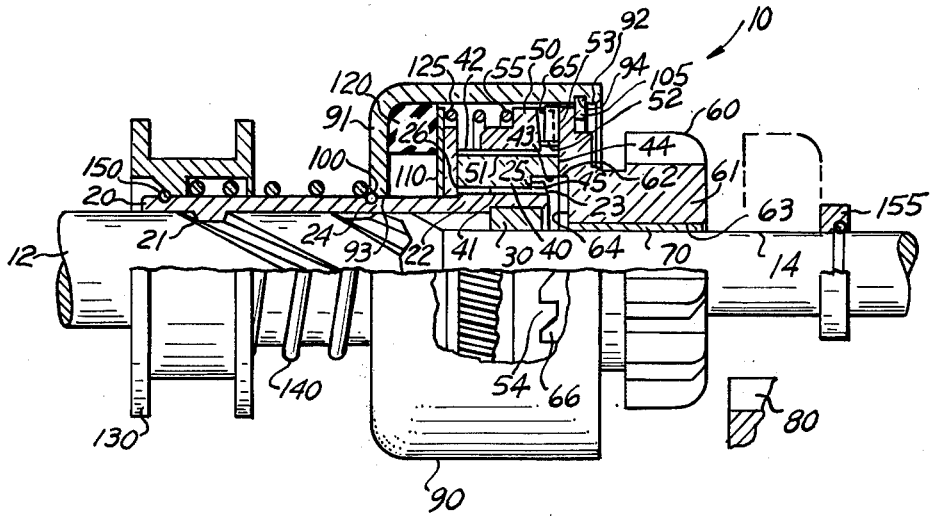
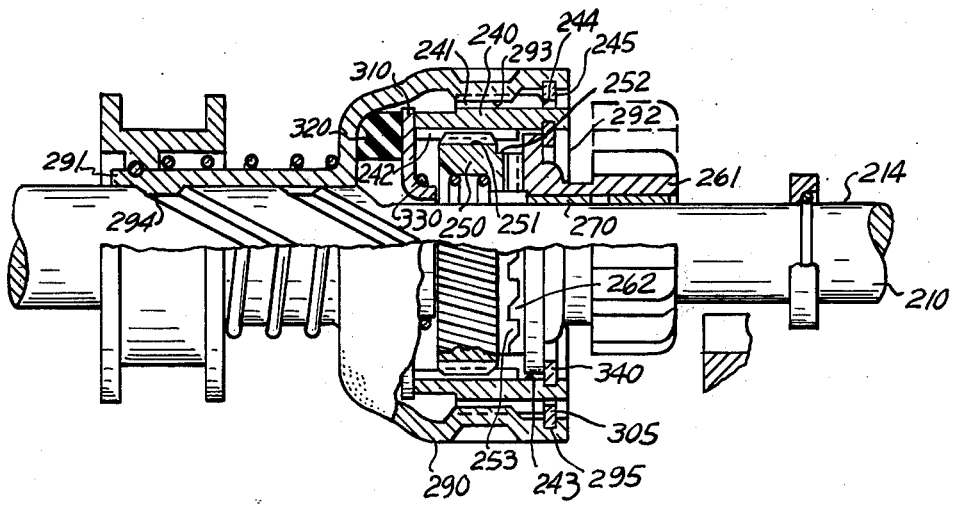
FIG. 2

ENGINE STARTER GEARING

BACKGROUND OF THE INVENTION

1. Field of the Invention

The present invention relates to the field of starter gearing in general and in particular to that portion of the field of starter gearing which relates to non-indexing positive shift dentil type overrunning clutch starter gearing.

2. Description of the Prior Art

Clutches of the general type described herein above are well known in the art, but the art teaches that such drives require rather complicated mechanisms to separate the dentils of the overrunning clutch. An example of such drive is illustrated in U.S. Pat. No. 3,263,509, by Digby, assigned to the assignee hereof. Such starter gearing mechanisms as illustrated in the above noted letters patent renders these drives suitable only for large engine installations, primarily large volume displacement diesel engines. A similar type of overrunning clutch suitable for smaller engine installations, i.e., engine installations requiring less than 70 lb. ft. of steady state torque during cranking, is illustrated in U.S. Pat. No. 3,714,834 by Digby, assigned to the assignee hereof. Initial development criteria of said smaller engine drive starters required the removing of the complicated dentil separation mechanism and reducing the drive in size in order to meet the objectives of suitability for smaller engine installations. However, such starter gearing suffered from a major defect, that is, the drive which was initially very reliable, eventually (within as little as one-fifth of its expected life) begins to suffer an impositiveness in engagement with the engine to be started. Initial examination of such drives has shown that a tooth abutment between the pinion gear and the gear of the engine to be started prevented engagement of the drive and allowed sufficient axial movement of the shifting mechanism for the starter motor contacts to be closed, thereby causing the power shaft to rotate. Such action occurring without the interengagement of the pinion and the ring gear of the engine resulted in tooth milling, either of the ring gear or of the pinion gear, which thereafter required expensive and time consuming replacement. To solve this initial problem, it was believed that the use of a bearing sleeve underneath the pinion gear, as well as a thrust bearing means interconnecting the pinion gear and starter gearing sleeve which couples the starter gearing to the rotary power shaft, would eliminate this problem. By providing an intermediate low friction member, or washer, between a high speed rotating pinion and a comparatively low speed rotating body (the bearing sleeve) the amount of rotary energy being transmitted from the pinion to the sleeve was minimized. However, the use of the bearing sleeve in conjunction with the thrust body restricted the use of a pinion gear size larger than the smallest sized pinion used on many of the small engine installations for this type of drive. Further, the interaction of the helical splines was such as to cause a servere axial load on the stop mounted to the power shaft, so as to result in some breakage of the shaft under these conditions. Also, the bearing sleeve had to be brazed to the body which is an expensive process and has caused problems such as breaking loose from the body to which it is brazed.

SUMMARY OF THE INVENTION

In order to solve the stated problems, the present invention is provided with a dentil type overrunning clutch which assures high torque transmitting capabilities and is further provided with a third sleeve which permits collapsing of the internal starter gear members to enable the rotary thrust loads to be absorbed by a resilient member inernal of the starter gearing. By providing the internal members to cause the torsional shock to be absorbed by the resilient member, it is possible to eliminate the bearing sleeve and thereby allow starter gear usage in applications heretofore unable to service. The third sleeve member utilizes a straight spline to enable the rotary thrust energy to be transmitted to the resilient member thereby eliminating the need of a bearing member under the pinion gear.

It is, therefore, the primary object of this invention to provide a starter drive which is suitable for smaller engine installations.

It is the further object of this invention to provide a low cost small sized pinion non-indexing positorque starter drive.

It is a further object of the present invention to provide an economical, reliable engine starter gearing having good torque transmitting characteristics and, further, having a long service life.

DESCRIPTION OF THE DRAWINGS

FIG. 1 depicts the starter gearing according to the present invention in a partial elevational, partial sectional, partially broken away view.

FIG. 2 depicts another embodiment of the present invention in a partial elevational, partial sectional, partially broken away view.

DESCRIPTION OF THE PREFERRED EMBODIMENT

Referring now to FIG. 1, there is illustrated the present invention which is starter gearing for an engine generally designated by the numeral 10, mounted on a power shaft 12 of a starter motor (not shown). The drive includes an elongated sleeve member 20 connected to the shaft 12 by helical splines 21 so as to be axially and rotatably movable relative to the shaft. The external surface of the forward or right hand extremity of the elongated sleeve member 20 has a straight spline 23 formed thereupon. The forward or right hand extremity 22 of the elongated member 20 is supported by a bearing member which in turn is slidably supported on the reduced diameter portion 14 of the power shaft 10. The straight spline 23 has a shoulder portion 25 at its most forward extremity for a purpose later to be described. The bearing member 30 enables the forward portion 22 of the elongated member 20 to transmit the torsional loads without excessively deflecting as a result of the smaller power shaft diameter in the forward area of said elongated sleeve member.

Coaxially disposed with respect to the elongated sleeve member 20 is an annular third sleeve member 40 with straight splines 41 on the internal surface of the third sleeve member and helical splines 42 on the external surface of said third sleeve member. The third sleeve member 40 further has a radial recess at the forward end 43 of said member extending radially outward of said inner surface beyond said straight splines 41. The shoulder 45 created by the radial recess is mutually engageable with the shoulder 25 of the elongated sleeve member 20. The shoulder 45 of the third sleeve member 40 abuts the shoulder 25 of the elongated sleeve member 20 during the overrunning mode and prevents the intermediate member from bearing against the pinion member due to a reactionary load created during the overrunning mode of operation. A driving clutch sleeve member 50 is adapted to be threaded to the helical splines of the third sleeve member 40 by mutually engageable helical splines 51 on the inside surface of said driving clutch sleeve member 50 and is further adapted to move axially and rotatably with respect to said third sleeve member. The driving clutch sleeve member has a radial recess 52 at the forward end, said recess being inwardly of said clutch inside surface. The driving clutch sleeve member further has a forward face 53 with torque transmitting dentil teeth 54 and a shoulder portion 55 on the outside diameter adapted to receive a biasing means.

A pinion gear 60 is slidably supported on a bearing means 70 mounted to the reduced diameter portion 14 of the power shaft. The pinion gear 60 is adapted for movement into and out of engagement with the engine gear 80. An annular driven clutch sleeve member 61 is integrally formed with the pinion gear 60 as the left most extension thereof as illustrated in the drawings. The driven clutch sleeve member 61 is formed to provide an annular or circular recess radially inwardly 62 of the inside bearing surface 63 of said clutch member. The annular recess right most inner extremity 64 and radial extremity 62 is adapted to provide a clearance for the forward movement of the forward end 22 of said elongated member 20 when the third sleeve member is pushed rearward into the resilient means 120.

The opposing or adjacent faces 53, 65 of the clutch members 50, 61 are provided with complementary mutually engageable inclined torque transmitting dentil teeth respectively 54, 66. The dentils are of the sawtooth variety and provide a one-way overrunning clutch connection.

A barrel shaped housing 90, having a closed end 91 and an opposite open end 92, is slideably supported 93 at its closed end on the external surface of the elongated sleeve member 20. A lock ring 100 is seated in a notch 24 in the elongated sleeve member adjacent to one end of the housing and establishes the left most extremity of the barrel housing. A second lock ring 105 is seated in a notch 94 in the barrel shaped housing adjacent to the open end of the housing, and has sufficient radial length to engage the driven clutch sleeve member 61 and thereby confine the clutch elements within the housing cavity. The rearward end of the straight splines on the forward extremity of the elongated member provide a shoulder portion 26 which abuts a spacer or washer means 110 slidably journaled on the elongated sleeve member 20. A resiliently yieldable annular member 120 preferably of an elastically deformable material such as rubber, is compressively confined between the closed end 91 of said housing and the washer or spacer means 110. A resilient spring member 125 is compressively confined between the washer means 110 and driving clutch sleeve member 50 to provide an axial force urging the clutch members 50, 61 into an engaged position.

Means for moving starter gearing assembly toward or away from the engine gear may comprise the conventional solenoid, air or hydraulic cylinder actuated lever, not illustrated, connected to a shift collar or ring 130, which is coupled to the closed end 91 of the barrel housing 90 by resilient means in the form of compressively confined spring 140. A stop ring 150 limits the leftward movement of the shift collar under the influence of the compression spring and thus defines the yoke end of the elongated sleeve member 20. A further stop 155 is provided on the power shaft to prevent the starter housing from over travelling when moved forward into the engaged position with the ring gear of the engine.

Thus, the interrelationship between the third sleeve member 40, integral driving sleeve and pinion gear 60, 61 and disc or washer means 110 is operative to provide an axially substantially solid interconnection, while the interrelationship of the washer means 110, annular resilient means 120, and closed end 91 of the barrel shaped housing establishes an axially substantial constant position of the barrel housing 90 relative to the third sleeve member 40.

OPERATION

In operation, when it is desired to start the engine, the starter gearing assembly is shifted to the right via a positioning mechanism connected to the shift collar and along the power shaft 12 so that the pinion gear 60 engages the engine starter gear 80. The shaft is rotated by a starting motor and transmits torque through the helical splines on the power shaft and the inner surface of the elongated sleeve member 20, to the external straight splines 23 on the forward portion of the elongated sleeve member, internal straight splines 41 on the third sleeve member 40, from the internal straight splines 41 on the third sleeve member 40 to the external helical splines 42 on the outer surface of the third sleeve member 40, from the outer surface helical splines 42 of the third sleeve member 40 to the helical splines 51 on the inner surface of the driving clutch sleeve member 50, through the mutually engageable inclined dentil torque transmitting teeth 54, 66 to the driven clutch sleeve member, to the pinion gear 60 of the driven clutch sleeve member 61 and finally to the engine ring gear 80. As the engine fires and becomes self-operating, the engine gear 80 will now drive the pinion gear 60 at a speed greater than that of the power shaft 12. The mutually engageable clutch teeth 54, 66 will slip and overrun at this point so that the starting motor is not driven at the high engine speed. This will result in the driven clutch sleeve member 61 forcing the driving clutch sleeve member 50 leftwards or backwards along the helical splines 42, 51 between the outer surface of the third sleeve member 40 and the inner surface of the driving clutch sleeve member 50, against the compression of the resilient means 125. The rearward movement of the driving cluch sleeve member causes a reactionary force to be developed as a result of the mutually engageable helical splines between the third sleeve member 40 and the driving clutch sleeve member. This reactionary force causes the third sleeve member to be forced toward the driven clutch sleeve member. The mutually engageable shoulders on the elongated sleeve member and the third sleeve member limit the forward movement of the third sleeve member, thereby limiting the axial thrust on the driven clutch sleeve member due to the movement of the third sleeve member.

In the event that the initial rightward motion of the starter gearing results in a tooth abutment between the pinion gear 60 and the engine ring gear 80, the shift ring 130 will continue to travel forward or rightward further compressing the spring 140. At some point approximately equivalent to the full rightward movement of the shift ring, the starter motor contacts will be closed and the motor will begin to rotate the power shaft 12. This in turn will have the effect of rotating the starter gearing assembly and the teeth abutment will be cleared. The drive will then advance forward under the compressionary force of the spring 140 and normal cranking can resume. Upon assuming the cranking position, the pinion gear will come to rest against a second stop 155 secured to the power shaft 12. Upon cranking of the starter motor, any torsional loads or axial loads as a result of the inadvertent over travel of the housing body 90 while the pinion is against the second stop 155 will be absorbed by the resilient means 120 through the substantially solid interconnection between the driven clutch sleeve member 61, the third sleeve member 40, and the washer or spacer means 110. Therefore, any torsional loads as a result of an abutment between the pinion 60 or the driven clutch sleeve member 61 and the second stop 155 will be translated axially along the straight splines 23, between the elongated member and the third sleeve member, back to the resilient means 120. Starter gearing according to the present invention, therefore, provides a means of absorbing the torsional shock by the resilient member 120 through a substantially solid interconnection.

In FIG. 2 is shown another embodiment of the present invention. The housing is a one piece housing 290 eliminating, therefore, the need of the elongated sleeve member 20 as shown in FIG. 1. The narrow end portion 291 of the housing has a helical spline 294 on the inside surface while the open end portion 292 of the housing has a straight spline 293 on its inside surface. The third sleeve member 240 in turn has a straight spline 241 on its outer surface while the spline on the inner surface is a helical spline 242. The forward portion of the helical spline as in the earlier shown embodiment has a shoulder portion 243. The shoulder portion 244 of the straight spline on the outer surface of the third sleeve member 240 is located against a retainer ring 305 which in turn mounts into a groove 295 in the inner surface of the open end of the housing. A driven sleeve member 261 is mounted to the narrow diameter 214 of the power shaft 210 with a bearing member 270 therein between.

The outer surface of the driving sleeve member 250 has a helical spline 251 mutually engageable with the helical spline 242 on the inside surface of the third sleeve member 240. The outer surface of the driving sleeve member 250 further has a radially inward recess 252 at the forward end portion of the driving member. The mutually engageable clutch teeth 253, 262 on the driven and driving sleeve members are inclined torque transmitting dentil teeth to transfer torque from the driving to the driven clutch sleeve member. A resilient member 320 is mounted at the closed end of the cavity of the one piece housing. Between the resilient member and the third sleeve member is mounted the washer or spacer means 310 mutually engageable with the third sleeve member and the resilient member. A compression spring 330 is further mounted coaxially with the washer means 310 to provide a force to keep the driving and driven clutch sleeve members in engagement. To retain the driven and driving clutch sleeve members in the housing, a second retainer ring 340 is mounted at the forward portion of the third sleeve member 240 in a groove 245 adapted therefor.

The means for moving the starter gearing assembly toward and away from the engine gear comprise essentially the same elements as those shown in FIG. 1 and will, therefore, not be restated here.

A starter gearing mechanism, according to the present invention, accomplishes all of the normal functions of impact cushioning, overrunning, torque transmission, and in addition, provides for absorbing torsional loads by the rubber cushion after the starter gearing is moved into engagement against the stop on the power shaft. Manufacturing is readily accomplished as the third sleeve member amy be of any suitable material which readily provides low friction surfaces for inter-engagement with driven and driving clutch sleeve members.

While specific embodiments of the invention have been shown and described in detail to illustrate the application of the inventive principles, it will be understood that the invention may be embodied otherwise without departing from the principle thought therein.

Having described the invention, what is claimed is:

1. Starter gearing comprising:

a shaft;

a driven clutch sleeve member mounted coaxially with said shaft, said driven clutch member having radially extending gear teeth on one end portion and axially extending dentil clutch teeth on the opposite end portion;

a driving clutch sleeve member mounted adjacent said driven clutch sleeve member, said driving clutch member havine one end portion and an opposite end portion, said one end portion having axially extending clutch teeth, said clutch teeth being inclined torque transmitting dentil teeth mutually engageable with said dentil clutch teeth of the driven clutch sleeve member for transmitting torque between said driven and driving clutch sleeve members;

a third sleeve member coaxially disposed with said driving clutch sleeve member, said third sleeve member having one end portion and an opposite end portion, said third sleeve member further comprising:

means for permitting axial movement of said third sleeve member with respect to said shaft;

means for limiting axial movement of said third sleeve member with respect to said shaft; and means for permitting axial and rotatable movement of said driving clutch sleeve member with respect to said third sleeve member;

means for maintaining into engagement the clutch teeth of said driving and driven clutch sleeve members for transmitting torque therebetween; and means for axially and rotatably translating said third sleeve member, driving clutch sleeve member and driven clutch sleeve member along said shaft.

2. The starter gearing as recited in claim 1 wherein the means for permitting axial and rotatable movement of said driving clutch sleeve member with respect to said third sleeve member further comprises:

a first helical thread on the outside surface of said third sleeve member;

a second helical thread on the inside surface of said driving sleeve member, said second helical thread adapted to mutually engage said first helical thread on said third sleeve member for communication therewith.

3. The starter gearing as recited in claim 1 wherein the means for permitting axial movement of said third sleeve member with respect to said shaft comprises:

an elongated member coaxially mounted to said shaft, said elongated member having one end portion and an opposite end portion, said one end portion having a straight spline interposed said third sleeve member and said elongated member; and a straight spline on the opposite end portion of said inside surface of the third sleeve member, said straight spline adapted to mutually engage said straight spline on said one end portion of said elongated member for communication therewith.

4. The starter gearing as recited in claim 2 wherein the means for limiting axial movement of said third sleeve member with respect to said shaft further comprises:

a radially outward annular recess on the inside surface of said one end portion of the third sleeve member, said recess further having a shoulder portion;

a radially outward annular protrusion on said one end portion of the elongated member, said protrusion having a shoulder portion mutually engageable with the shoulder portion of said radially outward annular recess of the third sleeve member; and a radially outward annular recess on the inside surface of said driven clutch sleeve member, said recess being sufficient to provide a clearance for the outward most portion of said protrusion on the elongated member.

5. The starter gearing as recited in claim 2 wherein the means for maintaining into engagement the clutch teeth of the driving and driven clutch sleeve members further comprises:

a barrel shaped housing mounted coaxially with said driven and driving clutch sleeve members, said housing having a cavity with an open end portion and an opposite closed end portion;

means for securing said closed end portion of the housing to said elongated member;

first resilient means disposed within the housing cavity adjacent said opposite closed end portion of the housing cavity;

an annular thrust spacer member interposed said resilient means and said third sleeve member;

second resilient means interposed said spacer member and said driving clutch sleeve member; and first means for retaining said opposite end portion of the driven clutch sleeve member within the housing cavity, said retaining means disposed adjacent said open end portion of said housing cavity.

6. The starter gearing as recited in claim 1 wherein the means for permitting axial and rotatable movement of the driving clutch sleeve member with respect to the third sleeve member further comprises:

a first helical thread on the inside surface of said third sleeve member;

a second helical thread on the outside surface of said opposite end portion of the driving clutch sleeve member, said second helical thread adapted to mutually engage said first helical thread on the inside surface of said third sleeve member;

a radially outward recess on the inside surface of said third sleeve member, said radially outward recess adapted to receive said opposite end portion of the driven clutch sleeve member; and second means for retaining said driven clutch sleeve member adjacent said driving clutch sleeve member.

7. The starter gearing as recited in claim 1 wherein the means for permitting axial movement of the third sleeve member with respect to the shaft comprises:

an elongated member having one end portion and an opposite end portion, said opposite end portion being coaxially mounted to said shaft, said one end portion of the elongated member having an open and portion and an opposite narrowed end portion defining a cup shaped housing cavity, said open end portion of said one end portion having a straight spline on the inside surface interposed said third sleeve member and said elongated member; and a straight spline on the outside surface of said third sleeve member, said straight spline adapted to mutually engage said straight spline on said inside surface of the open end portion of the one end portion of the elongated member for communication therewith.

8. The starter gearing as recited in claim 7 wherein the means for limiting axial movement of said third sleeve member includes:

a radially inward recess on the outside surface of said third sleeve member, said recess having a shoulder portion; and first means for retaining said third sleeve member within said cup shaped housing cavity.

9. The starter gearing as recited in claim 7 wherein the means for maintaining into engagement the clutch teeth of the driving and driven clutch sleeve members further comprises:

first resilient means disposed within said housing cavity adjacent said narrowed end portion of said one end portion of the elongated member;

an annular spacer member interposed said first resilient means and said third sleeve member;

second resilient means interposed said spacer member and said driving clutch sleeve member;

first means for retaining said opposite end portion of said driven clutch sleeve member adjacent said driving clutch sleeve member, said first retaining means mounted to said third sleeve member; and second means for retaining said third sleeve member within the housing cavity, said second retaining mens mounted adjacent the open end portion of said one end portion of the elongated member.

10. Starter gearing comprising:

a barrel shaped housing having a cavity with an open end and an opposite closed end, said housing further having a central axis;

an elongated sleeve member coaxially disposed with said housing, said elongated sleeve member having one end portion disposed within said housing cavity and an opposite end portion protruding through said opposite closed end of the housing, said one end portion of the elongated member having an inside surface adapted to provide a bearing surface and an outside surface having a straight spline, said outside surface of said one end portion further having a shoulder portion, said opposite end portion having an inside surface adapted to provide means for translating axial movement into rotatable movement, said opposite end further having an outside surface adapted to provide first means for biasing said housing, said biasing means being coaxially disposed with said opposite end portion of the elongated member;

means for mounting said housing to said elongated member, said mounting means interposed said one end portion and said opposite end portion of the elongated member;

a driving sleeve member coaxially disposed with said central axis of the housing, said driving sleeve member having axially extending clutch teeth on one end face, said driving sleeve member further having an inside surface with one end portion and an opposite end portion, said one end portion having a radially inwardly annular recess, said opposite end portion of the inside surface having a helical spline;

a driven clutch sleeve member coaxially disposed with respect to said central axis of the housing and adjacent to said driving sleeve member; said driven sleeve member having radially extending gear teeth on one end portion and axially extending clutch teeth on the opposite end portion, said clutch teeth being inclined torque transmitting dentil teeth mutually engageable with said clutch teeth of the driving clutch sleeve member for transmitting torque between said driving and driven sleeves when said driven sleeve member is rotated in one direction of relative rotation, said driven-sleeve member further having an annular recess on the inside surface of said opposite end portion;

a third sleeve member interposed said driving clutch sleeve member and said one end portion of the elongated sleeve member, said third sleeve member having one end portion and an opposite end portion, said one end portion having an inside surface with a radially outward annular recess, said recess further having a shoulder portion adapted to communicate with said shoulder portion on the one end portion of the elongated member, said opposite end portion of the third sleeve member having a straight spline on said inside surface, said straight spline adapted to communicate with said straight spline on the outside surface of the one end portion of the elongated member, said third sleeve member further having an outside surface with a helical spline for communicating with said helical spline on said opposite end portion of the inside surface of the driving clutch sleeve member;

resilient means disposed within the housing cavity adjacent said opposite closed end of the housing; and second means for biasing said driven clutch sleeve member into engagement with said driving clutch sleeve member.

11. The starter gearing as recited in claim 10 wherein the first means for biasing said housing further comprises:

a compression spring mounted coaxially with said opposite end portion of the elongated member adjacent said housing;

a shift ring member slideably mounted to said opposite end portion of the elongated member;

first means for limiting the axial movement of said shift ring with respect to said opposite end portion of said elongated member; and second means for limiting the axial movement of said driven sleeve member with respect to said shift ring member.

12. The starter gearing as recited in claim 10 wherein said means for translating axial movement into rotatable movement includes a helical spline on the inside surface of said elongated sleeve member.

13. The starter gearing as recited in claim 10 wherein said resilient means comprises an annular ring of an elastically deformable rubber material.

14. The starter gearing as recited in claim 10 wherein the second means for biasing said driven and driving clutch sleeves into engagement further comprises:

an annular thrust spacer member interposed said resilient means and said third sleeve member;

second resilient means interposed said spacer member and said driving clutch sleeve member; and first means for retaining said opposite end portion of the driven clutch sleeve member within the housing cavity, said retaining means disposed adjacent said open end portion of said housing cavity.

15. Starter gearing comprising:

a shaft;

an elongated member disposed coaxially with respect to said shaft, said elongated member having one end portion and an opposite end portion, said one end portion having an open end portion and an opposite narrowed end portion defining a cup shaped housing cavity, said open end portion of said one end portion further having a straight spline on the inside surface, said open end portion further having a radial groove on the inside surface adjacent said open end, said opposite end portion of the elongated member being slidably mounted to said shaft, said opposite end portion inside surface having means for permitting axial and rotatable movement of said elongated member with respect to said shaft, said opposite end portion outside surface having first means for biasing said one end portion of said elongated member;

a driven clutch sleeve member mounted coaxially with said shaft, said driven clutch member having radially extending gear teeth on one end portion and axially extending dentil clutch teeth on an opposite end portion;

a driving clutch sleeve member mounted adjacent said driven clutch sleeve member, said driving clutch member having one end portion and an opposite end portion, said one end portion having axially extending clutch teeth, said clutch teeth being inclined torque transmitting dentil teeth mutually engageable with said dentil clutch teeth of the driven clutch sleeve member for transmitting torque between said driven and driving clutch sleeve members, said one end portion further having an outside surface with a radially inward annular recess, said opposite end portion having an inside surface with a shoulder portion, said opposite end portion further having an outside surface with a helical spline thereon;

a third sleeve member coaxially disposed with said driving clutch sleeve member, said third sleeve member having an inside surface with a helical spline thereon, said helical spline being mutually engageable with said helical spline of the driving clutch sleeve member, said inside surface further having first means for engaging said clutch teeth of the driving clutch member with said clutch teeth of the driven clutch member, said third sleeve member having an outside surface, said outside surface having a straight spline, said straight spline being mutually engageable with the straight spline on said inside surface of the open end portion of the one end portion of the elongated member, said outside surface of the third sleeve member further having second means for engaging said clutch teeth of the driving clutch member with the clutch teeth of the driven clutch member;

resilient means disposed within the housing cavity adjacent said opposite narrowed end portion of said one end portion of the elongated member; and third means for engaging said clutch teeth of the driven and driving clutch members, said engaging means interposed said resilient means and said driving clutch sleeve member.

16. The starter gearing as recited in claim 15 wherein said first engaging means further comprises:

a radial groove disposed on said inside surface of the third sleeve member; and a first retainer member adapted to mount within said radial groove of said third sleeve member, said retainer member being of sufficient radial length to engage the opposite end portion of the driven clutch member and thereby retaining said opposite end portion of said driven clutch member within said one end portion of said elongated member.

17. The starter gearing as recited in claim 15 wherein the second means for engaging further comprises:

a second retainer member adapted to mount within said radial groove in the inside surface of said one end portion of the elongated member; and a radially inward recess on the outside surface of the third sleeve member, said recess having a shoulder portion adapted to engage said second retainer member, whereby said third sleeve member is retained within said one end portion of said elongated member.

18. The starter gearing as recited in claim 15 wherein the first biasing means further comprises:

an annular thrust spacer member interposed said resilient means and said third sleeve member; and second resilient means interposed said spacer member and said shoulder portion on said inside surface of said driving clutch sleeve member.

* * * * *

UNITED STATES PATENT AND TRADEMARK OFFICE

CERTIFICATE OF CORRECTION

PATENT NO. : 4,019,393

DATED : April 26, 1977

INVENTOR(S) : Harold R. Mortensen

It is certified that error appears in the above-identified patent and that said Letters Patent are hereby corrected as shown below:

Column 4, line 16, following the word "housing" please insert a ----comma (,)----.

Column 4, line 43, following the word "that" please insert ----of the speed----.

Column 6, line 14, please delete the word "amy" and insert therefore the word ----may----.

Column 6, line 33, please delete the word "havine" and insert therefore the word ----having----.

Column 8, line 13, please delete the word "and", first occurrence, and insert therefore the word ----end----.

Column 8, line 50, please delete the word "mens" and insert therefore the word ----means----.

UNITED STATES PATENT AND TRADEMARK OFFICE

CERTIFICATE OF CORRECTION

PATENT NO. : 4,019,393

DATED : April 26, 1977

INVENTOR(S) : Harold R. Mortensen

It is certified that error appears in the above-identified patent and that said Letters Patent are hereby corrected as shown below:

Column 9, line 5, after the word "interposed" please insert the word ----between----.

Column 9, line 30, after the word "driven" please delete ----hyphen (-)----.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*